US006945669B1

(12) United States Patent
Jester

(10) Patent No.: US 6,945,669 B1
(45) Date of Patent: Sep. 20, 2005

(54) FILM ENCAPSULATED STRAND OF LIGHTS

(76) Inventor: Randy D. Jester, 1795 Lake Cunningham Rd., Greer, SC (US) 29651

( * ) Notice: Subject to any disclaimer, the term of this patent is extended or adjusted under 35 U.S.C. 154(b) by 148 days.

(21) Appl. No.: 10/412,968

(22) Filed: Apr. 14, 2003

(51) Int. Cl.[7] ..... F21V 15/00
(52) U.S. Cl. ..... 362/227; 362/217; 362/223
(58) Field of Search ..... 362/249, 267, 362/227, 235, 217, 223

(56) References Cited

U.S. PATENT DOCUMENTS

| | | | | |
|---|---|---|---|---|
| 3,755,663 | A | 8/1973 | George, Jr. | 240/10 R |
| 4,042,290 | A | 8/1977 | Czitrom | 339/53 R |
| 4,096,379 | A | 6/1978 | Taylor | 362/235 |
| 4,413,311 | A | 11/1983 | Orenstein | 362/219 |
| 4,607,317 | A | 8/1986 | Lin | 362/249 |
| 4,654,765 | A | 3/1987 | Laidman | 362/238 |
| 4,855,882 | A | 8/1989 | Boss | 362/238 |
| 4,885,664 | A * | 12/1989 | Hermanson | 362/123 |
| 4,994,944 | A | 2/1991 | Vernondier | 362/249 |
| 6,406,166 | B1 | 6/2002 | Ko | 362/249 |
| 6,517,219 | B1 * | 2/2003 | Chen | 362/349 |
| 6,565,251 | B2 * | 5/2003 | Chen | 362/236 |
| 6,688,754 | B1 * | 2/2004 | Wu | 362/249 |
| 2003/0214809 | A1 * | 11/2003 | Wong | 362/249 |
| 2004/0012956 | A1 * | 1/2004 | Chen | 362/240 |

* cited by examiner

*Primary Examiner*—Laura K. Tso
(74) *Attorney, Agent, or Firm*—Charles L. Schwab; Nexsen Pruett, LLC

(57) ABSTRACT

A method and apparatus providing improved Christmas tree lights. A strand of Christmas tree lights is encapsulated in a thin translucent film of polymer.

9 Claims, 2 Drawing Sheets

FILM ENCAPSULATED STRAND OF LIGHTS

TECHNICAL FIELD

This invention relates to Christmas lighting systems and the like having a strand of insulated electric wires to which light emitting devices are attached.

BACKGROUND OF THE INVENTION

Existing Christmas lights consist of strings of small colored lights wired together in long series. The lights typically consist of replaceable bulbs in a variety of sizes. They are lightweight so that they can be supported by the branches of Christmas trees and other decorations; however, they are very prone to tangling. The bulbs are unprotected and often broken. Electrical hazard exists due to the possibility of metal decorations coming in contact with bulb electrical connections. Long life decorative light systems exist for home and vehicle use consisting of a strand of lights in rigid plastic or glass tubes. These rigid systems are not suitable for Christmas tree lights. Decorative "cable light" systems for homes and exterior structures exist, which include a strand of lights encapsulated in an extruded polymer sheath. These cable lights are large diameter, heavy lights which are unsuitable for Christmas tree lights. A normal 50-foot strand of cable lights weighs over three pounds, which would impose excessive weight on the tree limbs. Additionally, the stiff, solid, large diameter cables do not drape and conform to the placement necessary on a tree.

SUMMARY OF THE INVENTION

The Christmas tree lights of this invention preferably use small long life incandescent bulbs or preferably light emitting diodes (LED's), elecroluminesent lights or similar light emitting devices. The lights are preferably wired such that a failure of one will not affect the others in the strand. The wiring utilizes insulation to prevent short-circuiting of the strand. The wired strand may be threaded through a soft, tough, pliable clear plastic tube of shrink film that is subsequently shrunk tightly around the wiring and lights. Alternatively, the lights and wiring may be spiral wrapped with a band of stretch film or shrink film; preferably, with a heat seal layer on the inside of the overlapping spirals for forming a sealed encapsulation. Alternatively, a thin plastic film may be extruded around the light strand. Connections for connecting the strand to a power source or to an additional strand are attached to the ends of the strand in the conventional way. Translucent color can be incorporated into individual bulbs, or in the polymer, or applied to the sheath of polymer film. The polymer film sheath material is a flexible, tough, clear polymer such as PVC, LLDPE, PETG or others known to the industry and it could be a co-extruded multilayer film. The sheath is a film with a thickness between 1 mm and 0.02 mm, preferably less than 0.5 mm. The encapsulated strand has a diameter conforming to the lights and wiring due to the tight fitting thin film sheath and has a weight for a 50-foot strand of less than 1.5 pounds. The polymer, from which the sheath is made, may contain a flame retardant.

The strand of encapsulated lights is light weight and flexible, yet more tangle free than conventional Christmas tree lights. The encapsulation secures the lights against movement, provides safety against lamp breakage, provides protection against inclement weather when used outdoors and provides shock protection.

BRIEF DESCRIPTION OF THE DRAWINGS

Several embodiments of encapsulated strands of lights and several methods of making the encapsulated strands are illustrated in the drawings, in which.

DETAILED DESCRIPTION OF THE INVENTION

Figure 1:
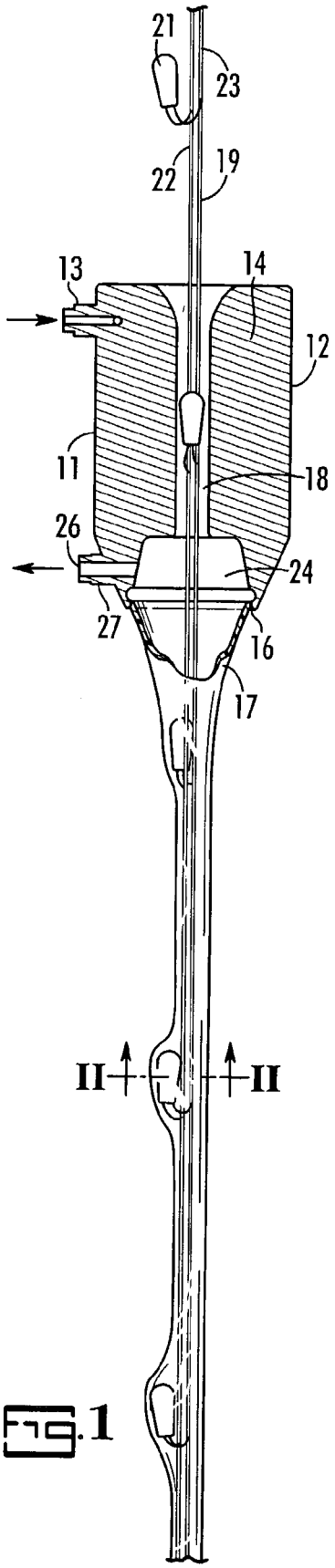
FIG. 1 is side view showing an extrusion die, in action, extruding a polymer film tube into which a strand of Christmas tree lights is simultaneously fed.

FIG. 1 illustrates a preferred method of producing the encapsulated Christmas tree lights. A film coating device 11 includes an extrusion die 12 having an inlet 13 at its top receiving pressurized molten polymer 14 and a lip at its bottom having a ring shaped opening 16 from which the molten polymer is extruded to form a thin wall tube 17 of polymer. The polymer is translucent. It may be clear or, as desired, it may be colored. The extrusion die 12 includes a central vertical passageway 18 through which a strand of Christmas tree lights 19 moves into the tube 17 in a continuous manner. The upper end of the passageway 18 is flared or cone shaped which causes the elongated bulbs 21 of the strand to be moved parallel to the wires 22, 23. An exterior cavity or chamber 24 in the lower end of the extrusion die 12 is connected to an outlet 26 by a conduit 27. The outlet 26 is connected to a vacuum pump. The reduced pressure in chamber 24 helps the extruded tube 17 to collapse and tightly encase the light strand 19.

Figure 2:
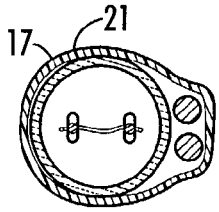
FIG. 2 is a section taken on the line II—II in FIG. 1.
Figure 3:
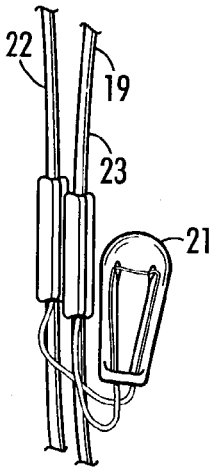
FIG. 3 is partial side view of part of a strand of Christmas lights showing a single light emitting device.

In a production operation, an encapsulated light strand is made by delivering a suitable pressurized molten polymer to the extrusion die 12 to cause the molten polymer to be extruded from the annular or ring shaped orifice or opening 16, thereby forming the thin film tube 17. Simultaneously, a strand 19 of Christmas tree lights is entered through the central passage 18 and into the molten polymer tube being formed. The reduced pressure created in the vacuum chamber 24, and the linear velocity of the strand exiting the die, helps to collapse the tube around the strand of lights. Downstream of the extrusion die 12, the film coating is solidified by cooling the molten polymer, thereby providing a tight fitting protective film cover for the encapsulated light strand, as shown in FIG. 2, in a continuous process.

The polymer may be a polyvinyl chloride, a linear low density polyethylene or a polyethylene terephthalate-glycol-modified or other thermo plastic polymers. The extruded sheath or tube has a wall thickness between 1 mm and 0.02 mm and preferably less than 0.5 mms. The light strand and sheath are designed to have a weight of not more than 1.5 pounds per 50-feet of length. The polymer sheath may contain a flame retardant and may be either clear or translucently colored. The shrunk polymer sheath fits tightly about the strand of lights, thereby restraining the lights or light bulbs against loosening. The tight fitting wrap makes the strand tangle resistant, reduces breakage and prevents short circuiting, while at the same time protecting the strand from inclement weather when used outdoors.

Figure 4:
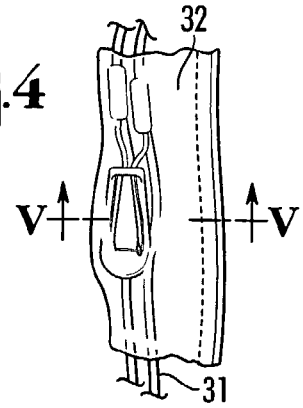
FIG. 4 is partial side view showing a strand of lights enclosed in a folded strip of heat shrink polymer.
Figure 5:
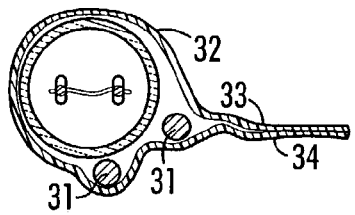
FIG. 5, is a section taken on line V—V in FIG. 4.

Referring to FIGS. 4 and 5, a strand 31 of Christmas tree lights is encapsulated in a folded strip 32 of polymer film having flat confronting edges 33, 34. The polymer is preferably coated with a heat seal layer on the inside surface so that when heat is applied to seal the edges 33, 34 to one another, the entire strip 32 is shrunk to tightly encapsulate the strand 31.

Figure 6:
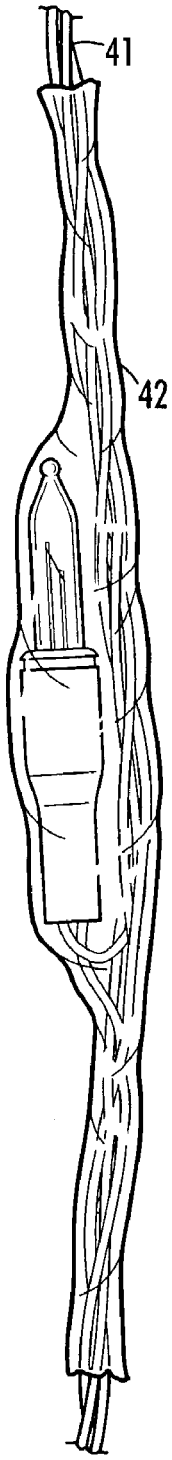
FIG. 6 is a partial side view of part of a strand of lights spiral wrapped by a band of polymer film which has been heat shrunk.

FIG. 6 shows a strand 41 of Christmas tree lights spiral wrapped with a polymer band or tape 42 which has been subjected to heat to heat shrink it to a tight fitting encapsulated condition. The side of the polymer tape 42 confronting the strand 41 has a heat sealing coating which not only seals the overlapping spirals of the band 42 to one another but also restrains movement of the lights and wires.

Figure 7:
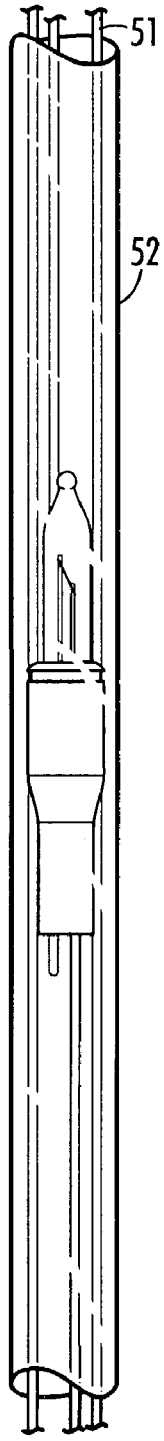
FIG. 7 is a partial side view of a strand of lights in a heat shrinkable polymer tube.
Figure 8:
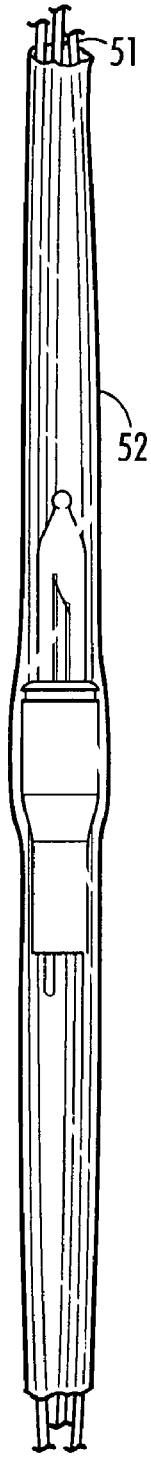
FIG. 8 is a partial side view of the encapsulated strand of FIG. 7 after application of heat.

FIGS. 7 and 8 illustrate a method of encapsulating a strand 51 of Christmas lights which includes forming a thin wall tube 52 of suitable heat shrink polymer, placing the strand 51 of the lights in the tube and then subjecting the tube 52 to heat to shrink it to the condition shown in FIG. 8.

What is claimed is:

1. An encapsulated strand of lights comprising:

a plurality of insulated electric wires alongside one another, a plurality of light emitting devices connected in current receiving relation to said wires at predetermined spaced intervals from one another, and a folded strip of translucent polymer heat shrinkable film with a heat seal layer on the inside of the fold sealed and shrunk by heat tightly around said wires and light emitting devices in an encapsulating manner.

2. The encapsulated strand of claim 1 wherein said film has a thickness between 1 mm and 0.02 mm.

3. The encapsulated strand of claim 2 wherein said film has a thickness between 0.5 mm and 0.02 mm.

4. The encapsulated strand of lights of claim 1 wherein said light emitting devices are light emitting diodes.

5. The encapsulated strand of lights of claim 1 wherein said light emitting devices are elongated bulbs lying parallel to said wires.

6. A method of encapsulating a strand of lights in a translucent film comprising:

providing a strand of lights having a plurality of wires alongside one another and light emitting devices connected to said wires and positioned at spaced intervals to one another, providing an extrusion die capable of extruding a tube of translucent molten polymer and having a central passageway permitting entry of a strand of lights to said tube as it is formed, operating said extrusion die to form a tube of thin transparent molten polymer, passing said strand of lights into said tube by linear movement simultaneous with the formation of said tube, applying a vacuum to the interior of said tube, said linear movement of said strand and said application of said vacuum causing said tube to form tightly around said strand and cooling said tube of molten polymer.

7. The method of claim 6 and further comprising adding a flame retardant to said polymer.

8. The method of claim 6 wherein said tube is colored.

9. An encapsulated strand of lights comprising:

a plurality of insulated electric wires alongside one another, a plurality of light emitting devices connected in current receiving relation to said wires at predetermined spaced intervals from one another, and a translucent polymer tape spiral wrapped with overlapping spirals and heat shrunk tightly around said wires and light emitting devices in an encapsulating manner, said tape having a heat seal layer on the inside of the spirals sealing said overlapping spirals to one another.

* * * * *